US009433068B2

(12) United States Patent
Shirai

(10) Patent No.: US 9,433,068 B2
(45) Date of Patent: Aug. 30, 2016

(54) DISCHARGE ELECTRODES FOR USE IN A LIGHT SOURCE DEVICE

(71) Applicant: USHIO DENKI KABUSHIKI KAISHA, Tokyo (JP)

(72) Inventor: Takahiro Shirai, Yokohama (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/437,652

(22) PCT Filed: Oct. 22, 2013

(86) PCT No.: PCT/JP2013/078556

§ 371 (c)(1),
(2) Date: Apr. 22, 2015

(87) PCT Pub. No.: WO2014/069283

PCT Pub. Date: May 8, 2014

(65) Prior Publication Data

US 2015/0282285 A1 Oct. 1, 2015

(30) Foreign Application Priority Data

Oct. 30, 2012 (JP) ..... 2012-239007

(51) Int. Cl.
*H05B 41/30* (2006.01)
*H05G 2/00* (2006.01)
*H01J 61/06* (2006.01)

(52) U.S. Cl.
CPC ..... *H05B 41/30* (2013.01); *H01J 61/06* (2013.01); *H05G 2/003* (2013.01); *H05G 2/005* (2013.01); *H05G 2/008* (2013.01)

(58) Field of Classification Search
CPC ..... H05G 2/003; H05G 2/005; H05G 2/008; H05G 2/006; H05G 2/001; H05G 2/00; G03F 7/70033; H05B 41/30; H05B 6/105; H05B 6/36
See application file for complete search history.

(56) References Cited

U.S. PATENT DOCUMENTS 7,427,766 B2 9/2008 Jonkers et al.
2007/0090304 A1* 4/2007 Jonkers ..... H05G 2/003 250/504 R

FOREIGN PATENT DOCUMENTS

JP 2007-505460 A 3/2007

OTHER PUBLICATIONS

International Search Report; PCT/JP2013/078556; Dec. 3, 2013.

*Primary Examiner* — Jany Richardson
(74) *Attorney, Agent, or Firm* — Studebaker & Brackett PC

(57) ABSTRACT

Each of two discharge electrodes is partially immersed in a container, and rotations of the electrode cause a high-temperature plasma material adhering to the electrode to be conveyed into a discharge space. EUV light is emitted by generating a pulse discharge between the electrodes in a state where the high-temperature plasma material is vaporized. A plurality of capturing grooves for capturing the high-temperature plasma material are provided in the form of a plurality of concentric circles near the outer periphery of each discharge electrode. When each discharge electrode rotates, the high-temperature plasma material, which adheres to an area unnecessary for plasma generation, flows into the capturing grooves. As a result, the film thickness of the high-temperature plasma material does not increase very much at the outer periphery of each electrode, and it is possible to suppress the scattering of the high-temperature plasma material into a chamber interior.

18 Claims, 12 Drawing Sheets

VIEWED IN A DIRECTION OF ARROW A

ENLARGED CROSS-SECTIONAL VIEW TAKEN ALONG LINE B-B

LOW SPEED ROTATION

MIDDLE SPEED ROTATION

HIGH SPEED ROTATION

CROSS-SECTIONAL VIEW TAKEN ALONG LINE B-B

CROSS-SECTIONAL VIEW TAKEN ALONG LINE C-C

WHEN THREE GROOVES ARE FORMED IN EACH FLAT SURFACE

ENLARGED CROSS-SECTIONAL VIEW TAKEN ALONG LINE B-B

WHEN TWO GROOVES ARE FORMED IN EACH FLAT SURFACE

ENLARGED CROSS-SECTIONAL VIEW TAKEN ALONG LINE B-B

WHEN THREE GROOVES ARE FORMED IN EACH FLAT SURFACE

ENLARGED CROSS-SECTIONAL VIEW TAKEN ALONG LINE B-B

CROSS-SECTIONAL VIEW TAKEN ALONG LINE B-B

LOW SPEED ROTATION

MIDDLE SPEED ROTATION

HIGH SPEED ROTATION

CROSS-SECTIONAL VIEW TAKEN ALONG LINE A-A

DISCHARGE ELECTRODES FOR USE IN A LIGHT SOURCE DEVICE

TECHNICAL FIELD

The present invention relates to a discharge electrode for use in a light source device such as an extreme ultraviolet light source device. In particular, the present invention relates to discharge electrodes for use in a light source device that is configured to apply a pulsing electric power between the discharge electrodes while rotating the discharge electrodes, in order to generate plasma and emit light such as extreme ultraviolet light.

BACKGROUND ART

As semiconductor integrated circuits are designed in a fine structure and/or in a highly integrated manner, a light source for exposure tends to have an even shorter wavelength. As a next generation light source for exposure of semiconductor, an extreme ultraviolet (EUV) light source is studied. Such light source can emit extreme ultraviolet light at a particular wavelength (i.e., 13.5 nm).

There are some known methods for the EUV light source device to generate (emit) the extreme ultraviolet light. One of the known methods heats an EUV radiation species (seed) for excitation. This generates a high temperature plasma. Then, the extreme ultraviolet light is extracted from the high temperature plasma.

The EUV light source device that employs such method is generally categorized into two types depending upon a way of generating the high temperature plasma. One type is a laser produced plasma (LPP) type EUV light source device. Another type is a discharge produced plasma (DPP) type EUV light source device.

A DPP type EUV light source device will be described briefly.

FIG. 10 of the accompanying drawing is a view useful to briefly describe a DPP type EUV light source device disclosed in Patent Literature 1. FIG. 11 illustrates a discharge electrode and a container in a D-D cross-section of FIG. 10. FIG. 12 is a set of cross-sectional views, each taken along the line A-A in FIG. 10.

The EUV light source device has a chamber 1, which is a discharge vessel. In the chamber 1, there are provided a discharge part 1*a* and an EUV light condensing part 1*b*. The discharge part 1*a* includes a pair of disc-shaped discharge electrodes 2*a* and 2*b*. The EUV light condensing part 1*b* includes a foil trap 5 and an EUV light condensing mirror 6, which is a light condensing unit.

A gas discharge unit 1*c* is used to evacuate the discharge part 1*a* and the EUV light condensing part 1*b* such that the interior of the chamber 1 becomes vacuum.

Reference numerals 2*a* and 2*b* designate disc-shaped discharge electrodes. The discharge electrodes 2*a* and 2*b* are spaced from each other by a predetermined distance. As motors 16*a* and 16*b* rotate, the electrodes 2*a* and 2*b* rotate about shafts 16*c* and 16*d*.

A high temperature plasma material 14 is a material to emit EUV light at a wavelength of 13.5 nm. The plasma material 14 is, for example, liquid tin (Sn) and received in containers 15 and 15. The plasma material 14 is heated and becomes melted metal. As shown in FIG. 11, the temperature of the melted metal is adjusted by a temperature adjusting unit 15*a* disposed in, for example, each of the containers.

The electrodes 2*a* and 2*b* are partially immersed in the plasma material 14 in the associated containers 15 and 15, respectively. The liquid plasma material 14 that rides on the surface of each of the discharge electrodes 2*a*, 2*b* is conveyed into the discharge space upon rotation of the discharge electrode 2*a*, 2*b*. The high temperature plasma material 14 which is moved into the discharge space is irradiated with the laser beam 17 emitted from a laser source 17*a*. Upon irradiation with the laser beam 17, the high temperature plasma material 14 evaporates.

As shown in FIG. 11, for example, the laser beam is directed to the curved surface of the disc-shaped electrode 2*a*, 2*b*.

As described above, each of the disc-shaped discharge electrodes is partly immersed in the associated container 15, and rotates. The container 15 retains the high temperature plasma material. Thus, as shown in FIG. 11, the high temperature plasma material, which is melted and received in the container, annularly adheres to the circular flat surface of the disc-shaped discharge electrode 2*a*, 2*b*. The high temperature plasma material also adheres to the curved surface of the disc-shaped discharge electrode 2*a*, 2*b*.

As such, when the curved surface of the disc-shaped discharge electrode 2*a*, 2*b* is irradiated with the laser beam, the curved surface to which the high temperature plasma material adheres is an "area necessary for plasma" whereas the annular area on the circular flat surface to which the high temperature plasma material annularly adheres is an "area unnecessary for plasma."

While the high temperature plasma material 14 is vaporized upon irradiation with the laser beam 17, a pulse electric power is applied to the electrodes 2*a* and 2*b* from a power source unit 4. Thus, a pulse discharge is triggered between the discharge electrodes 2*a* and 2*b*, and a plasma P is produced from the high temperature plasma material 14. A large current is caused to flow upon the discharging. The large current heats and excites the plasma such that the plasma temperature is elevated. As a result, the EUV light is emitted from the high temperature plasma P.

It should be noted that the pulse electric power is applied between the discharge electrodes 2*a* and 2*b*. Thus, the resulting discharge is the pulse discharge, and the emitted EUV light is light emitted like a pulse, i.e., pulse light (pulsing light).

The EUV light emitted from the high temperature plasma P is condensed to a condensing point f of the light condensing mirror 6 (also referred to as "intermediate condensing point f" in this specification) by the EUV light condensing mirror 6. Then, the EUV light exits from an EUV light outlet 7, and is incident to an exposure equipment 40 attached to the EUV light source device. The exposure equipment 40 is indicated by the broken line.

According to this method, it is easy to vaporize Sn, which is solid at room temperature, in the vicinity of the discharge region where the discharge takes place. The discharge region is the space for the discharge between the discharge electrodes. Specifically, it is possible to efficiently feed the vaporized Sn to the discharge region, and therefore it becomes possible to efficiently extract the EUV radiation at the wavelength of 13.5 nm after the discharging.

The EUV light source device disclosed in Patent Literature 1 has the following advantages because the discharge electrodes are caused to rotate.

(1) It is possible to always feed a solid or liquid high temperature plasma material to the discharge region. The plasma material is a fresh material of an EUV generation species.

(2) Because the position on each discharge electrode surface, which is irradiated with the laser beam, and the position of the high temperature plasma generation (position of the discharge part) always change, the thermal load on each discharge electrode reduces, and therefore it is possible to reduce or prevent the wear of the discharge electrodes.

LISTING OF REFERENCES

Patent Literatures

PATENT LITERATURE 1: Japanese Patent Application Laid-Open Publication No. 2007-505460

SUMMARY OF THE INVENTION

Problems to be Solved

When the above-described EUV light source device is employed as a light source for exposure, the EUV light source device is required to perform EUV radiation at a repetition rate as high (fast) as possible, in view of desired control on the exposure.

In order to always feed the high temperature plasma material, which is a fresh EUV generation species (seed), to the discharge area, and to always change the irradiation position of the laser beam on the surface of the discharge electrode (laser landing position on the discharge electrode surface) and the position of the high temperature plasma generation (position of the discharge part), the discharge electrodes need to rotate at a higher speed. The discharge electrodes need to rotate faster as the repetition rate of the EUV radiation becomes higher.

When the rotation speed of each of the discharge electrodes increases, the centrifugal force that acts on the outer periphery of the discharge electrode and the vicinity of the outer periphery naturally increases.

Accordingly, as the rotation speed of each of the disc-shaped discharge electrodes increases, the centrifugal force acts on the high temperature plasma material, which adheres onto each of the rotating discharge electrodes.

It should be recalled here that not only the "area necessary for plasma generation" of each disc-shaped discharge electrode but also the "area unnecessary for plasma generation" of each disc-shaped discharge electrode are immersed in the high temperature plasma material in the associated container, as described above. Thus, the high temperature plasma material also adheres to the "area unnecessary for plasma generation" of each discharge electrode.

Part of the high temperature plasma material, which adheres to the "area necessary for plasma," is irradiated with the laser beam and vaporized. On the other hand, the high temperature plasma material, which adheres to the "area unnecessary for plasma," is not irradiated with the laser beam and is not vaporized. Accordingly, the high temperature plasma material moves toward the outer periphery of the disc-shaped discharge electrode as the rotation speed of the discharge electrode increases.

Specifically, as shown in FIG. 12(*a*), the high temperature plasma material 14, which adheres to the "area unnecessary for plasma," hardly moves when the rotation speed of the discharge electrode 2*a* is low. As shown in FIG. 12(*b*), however, the high temperature plasma material 14 moves toward the outer periphery of the disc-shaped discharge electrode 2*a* as the rotation speed of the discharge electrode 2*a* increases to an intermediate speed. Thus, the thickness of a layer (film) of the high temperature plasma material 14 increases at the outer periphery of the discharge electrode 2*a*.

Eventually, as shown in FIG. 12(*c*), when the rotation speed of the discharge electrode 2*a* increases to the high speed, liquid droplets of high temperature plasma material 14, which leave the electrode surface, are created (indicated by "flying material" in the drawing). These droplets scatter in uncontrolled (involuntary) directions, and contaminate an inner wall of the chamber and the components disposed in the chamber.

One approach for restricting (suppressing) the above-described scattering of the droplets of high temperature plasma material is to reduce the depth of immersion of the rotating electrode in the high temperature plasma material retained in the container as much as possible, and to reduce the "area unnecessary for plasma."

However, the temperature of the rotating electrode rises as the rotating electrode is irradiated with the laser beam and the discharge takes place. If no cooling is carried out, problems occur, i.e., the material on the rotating electrode surface is vaporized, and the rotating electrode deforms.

The cooling is carried out by the heat exchange between the rotating electrode and the high temperature plasma material. The heat exchange takes place when the heated electrode (rotating electrode) is immersed in the high temperature plasma material retained in the container.

As such, the depth of immersion of the rotating electrode in the high temperature plasma material pooled in the container should have a certain value to ensure the cooling of the rotating electrode. Therefore, it is difficult to reduce the "area unnecessary for plasma."

It should be noted that a circulation mechanism (not shown) is disposed in each of the containers to circulate the high temperature plasma material. In each of the containers, the heat is removed from the rotating electrode by the heat exchange. The high temperature plasma material having the elevated temperature is cooled as the high temperature plasma material is caused to flow through a circulation passage by the circulation mechanism. After cooling, the high temperature plasma material is re-introduced (re-pooled) to the container.

The present invention is proposed in view of the above-described problems, and an object of the present invention is to provide a disc-shaped discharge electrode that can suppress the scattering of the high temperature plasma material, which adheres to the discharge electrode, into the chamber even when the rotation speed of the discharge electrode becomes high. Such discharge electrode can cope with the high speed repetition of EUV radiation. Another object of the present invention is to provide an extreme ultraviolet light source that uses such discharge electrodes.

Solution to the Problems

In order to overcome the above-described problems, the present invention provides a disc-shaped discharge electrode that has a plurality of capturing (trapping) grooves to capture the high temperature plasma material which adheres to the "area unnecessary for plasma generation."

Specifically, a plurality of capturing grooves are provided, in the form of concentric circles, on the disc-shaped discharge electrode in an area where the high temperature plasma material adheres. The high temperature plasma material that moves toward the outer periphery of the discharge electrode upon rotations of the disc is captured (trapped) by the capturing grooves. Thus, the high temperature plasma material does not move to the outer periphery of the discharge electrode.

It should be noted that the discharge electrode rotates at a high speed, and may deform and break if the thickness of the electrode is reduced. Thus, there is a limitation on the reduction of the discharge electrode thickness. If the depth of the capturing grooves is small, it is not possible to sufficiently capture the high temperature plasma material, which adheres to the "area unnecessary for plasma generation." The high temperature plasma material may overflow from the grooves.

To deal with this, the present invention provides a plurality of capturing grooves concentrically, as described above. This configuration can reliably capture the high temperature plasma material, which adheres to the "area unnecessary for plasma," and prevent the high temperature plasma material from moving to the outer periphery of the discharge electrode.

In order to avoid the overflow of the high temperature plasma material, which is once captured in the capturing grooves, the present invention provides a material removing mechanism that has a rod-like shape. The front end of the material removing mechanism can enter and retract from the capturing groove(s) of the discharge electrode. This mechanism removes the high temperature plasma material, which is captured in the capturing grooves.

Based on the foregoing, the present invention overcomes the above-described problems in the following manner.

(1) According to a first aspect, the present invention is directed to discharge electrodes of a light source device. The light source device includes a pair of disc-shaped discharge electrodes spaced from each other, a pulse electric power feed unit for feeding a pulsing electric power to the discharge electrodes, material feed units for feeding a material onto the discharge electrodes for light emission (radiation) respectively, and an energy beam irradiating unit for irradiating the material on a curved surface of each discharge electrode with an energy beam to vaporize the material. Each of the material feed units has a container, which pools (retains) the melt of the material (melted material). As each of the discharge electrodes rotates, part of each discharge electrode passes through the melt of the material retained in the container, and the material adheres to that part of each discharge electrode. Each discharge electrode has two circular flat surfaces. A plurality of capturing grooves are formed on each of the two circular flat surfaces in the form of concentric circles such that the concentric (annular) grooves extend in a certain part of an annular region where the material adheres.

(2) For use with the discharge electrodes of the first aspect, the second aspect of the present invention provides a material removing mechanism having a rod shape, and a front end (tip) of the material removing mechanism can move into and out of each of the capturing grooves.

(3) The third aspect of the present invention is directed to the discharge electrodes of the first or second aspect, and at least one of the capturing grooves has a different depth from the remaining groove(s).

(4) The fourth aspect of the present invention is directed to the discharge electrodes of the third aspect, and a ratio of depths of the capturing grooves to each other is equal to or substantially equal to a ratio of lengths of respective flat regions next to the capturing grooves on the center side of the circular flat surface in a radial direction to each other. The high temperature plasma material adheres on the respective flat regions of each circular flat surface of each disc-shaped discharge electrode.

(5) The fifth aspect of the present invention is directed to the discharge electrodes of the first, second, third or fourth aspect, and an angle of a sidewall of each capturing groove has a negative value relative to a reference plane when one of the circular flat surfaces of the discharge electrode is the reference plane.

Advantageous Effects of the Invention

The present invention can provide the following advantages.

(1) Because a plurality of annular capturing grooves are concentrically formed on each of the two circular surfaces of each discharge electrode in a certain part of an annular region where the material adheres, it is possible to reliably capture the high temperature plasma material, which adheres to an area unnecessary for plasma generation of each discharge electrode. Accordingly, even when the rotations per minute of each discharge electrode become high, it is possible to suppress the scattering of the high temperature plasma material into the chamber from the discharge electrodes.

(2) Because a plurality of capturing grooves are formed, it is possible to sufficiently capture the high temperature plasma material, which adheres to the area unnecessary for plasma generation, even if each of the grooves is shallow and an amount of high temperature plasma material to be captured by each groove is small. Thus, it is possible to prevent the high temperature plasma material from overflowing from the grooves.

(3) The material removing mechanisms that can move into and out of the capturing grooves are provided. Therefore, it is possible to remove the captured high temperature plasma material, if necessary, before the high temperature plasma material overflows from the capturing groove concerned.

(4) The capturing grooves have different depths. A ratio of the capturing groove depths to each other is decided to become equal to or substantially equal to a ratio of lengths of respective flat regions next to the capturing grooves on the center side of the circular flat surface in a radial direction to each other. The high temperature plasma material adheres onto the respective flat regions in each circular flat surface of each disc-shaped discharge electrode. This can equalize an amount of high temperature plasma material to be caught by the respective capturing grooves.

(5) The angle of the sidewall of each capturing groove has a negative value relative to the reference plane when one of the circular flat surfaces of each discharge electrode is the reference plane. Accordingly, it is possible to efficiently capture the unnecessary high temperature plasma material.

DESCRIPTION OF EMBODIMENTS

Figure 1:
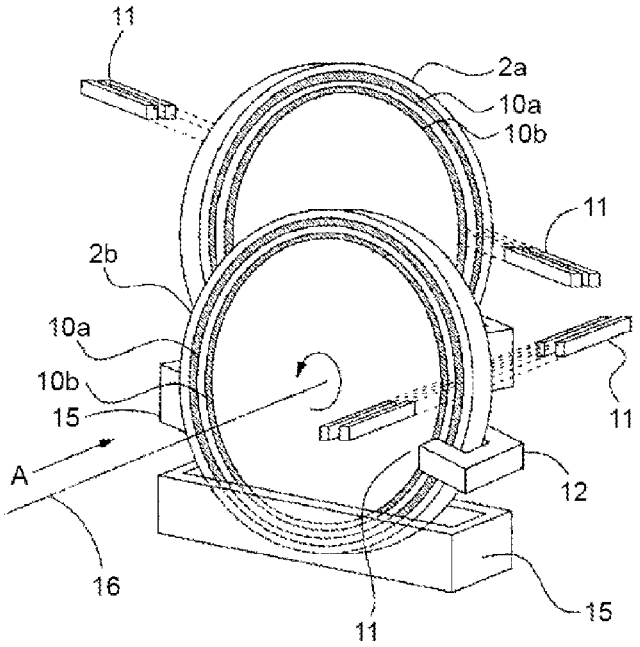
FIG. 1 shows discharge electrodes according to an embodiment of the present invention.
Figure 2A:
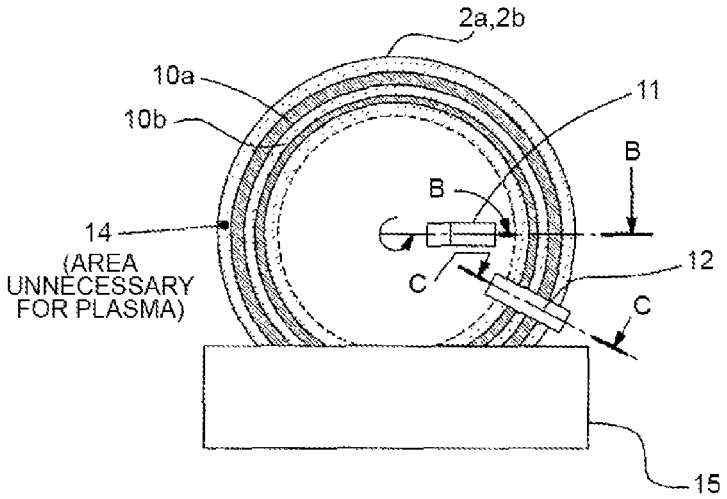
FIG. 2(*a*) shows the discharge electrode of FIG. 1 when viewed in the direction of the arrow A in FIG. 1, and FIG. 2(*b*) shows a cross-sectional view taken along the line B-B in FIG. 2(*a*).
Figure 2B:
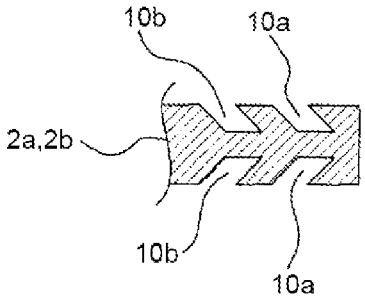
Figure 3A:
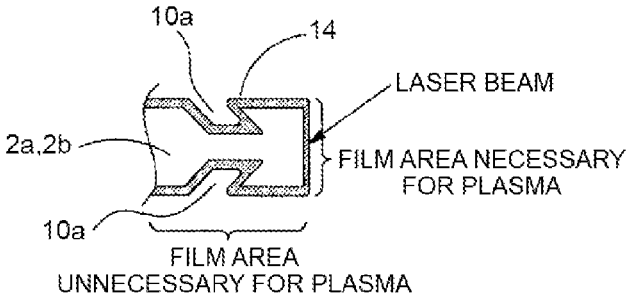
FIG. 3 is a set of views useful to describe capturing of a high temperature plasma material by capturing grooves. Specifically, FIG. 3(*a*) shows the plasma material when the discharge electrode rotates at a low speed, FIG. 3(*b*) shows the plasma material when the discharge electrode rotates at a middle speed, and FIG. 3(*c*) shows the plasma material when the discharge electrode rotates at a high speed.
Figure 3B:
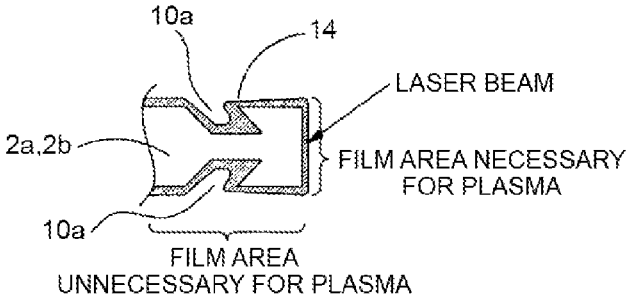
Figure 3C:
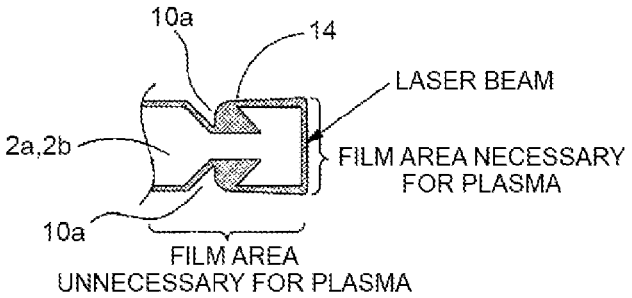
Figure 4:
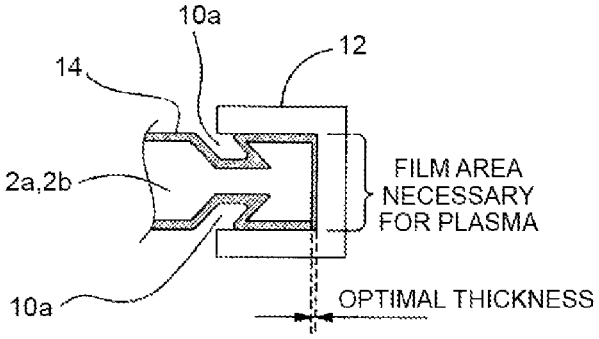
FIG. 4 is a view useful to describe a film thickness adjusting mechanism (cross-sectional view taken along the line C-C in FIG. 2(*a*)).

FIG. 1 shows discharge electrodes 2*a* and 2*b* according to an embodiment of the present invention. FIG. 2(*a*) is a drawing when viewed in the direction of the arrow A in FIG. 1. FIG. 2(*b*) is a cross-sectional view taken along the line B-B in FIG. 2(*a*). FIG. 3 is a set of views useful to describe the capturing (trapping, catching) of a high temperature plasma material by capturing grooves. FIG. 4 is a cross-sectional view taken along the line C-C in FIG. 2. It should be noted that the capturing grooves 10*a* are only illustrated in FIGS. 3 and 4.

Figure 5:
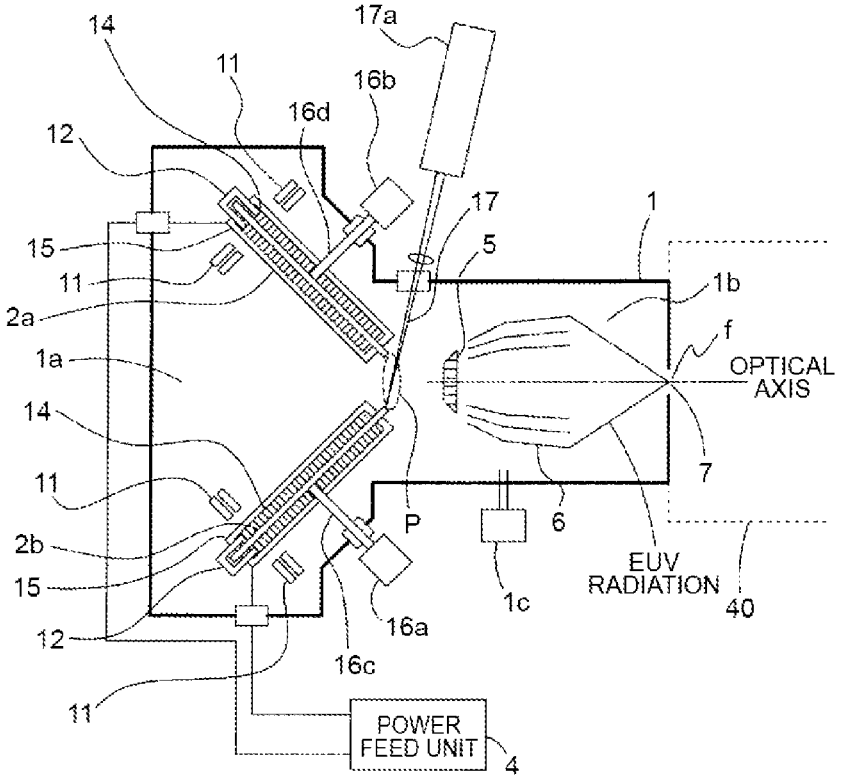
FIG. 5 is an exemplary configuration of an EUV light source device that uses the discharge electrodes according to the embodiment of the present invention.

FIG. 5 shows an exemplary configuration of an EUV light source device that uses the discharge electrodes 2*a* and 2*b* according to the embodiment of the present invention which is shown in FIG. 1. The EUV light source device shown in FIG. 5 has a similar configuration to the light source device shown in FIG. 10 except for the discharge electrodes 2*a* and 2*b* of the present invention, material removing mechanisms 11, and film thickness adjusting mechanisms 12, which are not depicted in FIG. 10. In the following description, therefore, the discharge electrodes 2*a* and 2*b* of the present invention, the material removing mechanisms 11 and the film thickness adjusting mechanisms 12 will primarily be described, and other elements and components will briefly be described.

Referring first to FIG. 5, the EUV light source device according to the embodiment of the present invention will be described briefly.

As shown in FIG. 5, there are provided a discharge part 1*a* and an EUV light condensing part 1*b* in the chamber 1, as described above. The discharge part 1*a* includes the discharge electrodes 2*a* and 2*b* as well as other components therein. The EUV light condensing part 1*b* includes a foil trap 5, an EUV light condensing mirror 6, and other components therein. A gas discharge unit 1*c* is attached to the EUV light source device. The gas discharge unit 1*c* is used to evacuate the interior of the chamber 1. The discharge electrodes 2*a* and 2*b* rotate about rotation shafts 16*c* and 16*d* as associated rotating motors 16*a* and 16*b* rotate, respectively.

Figure 11:
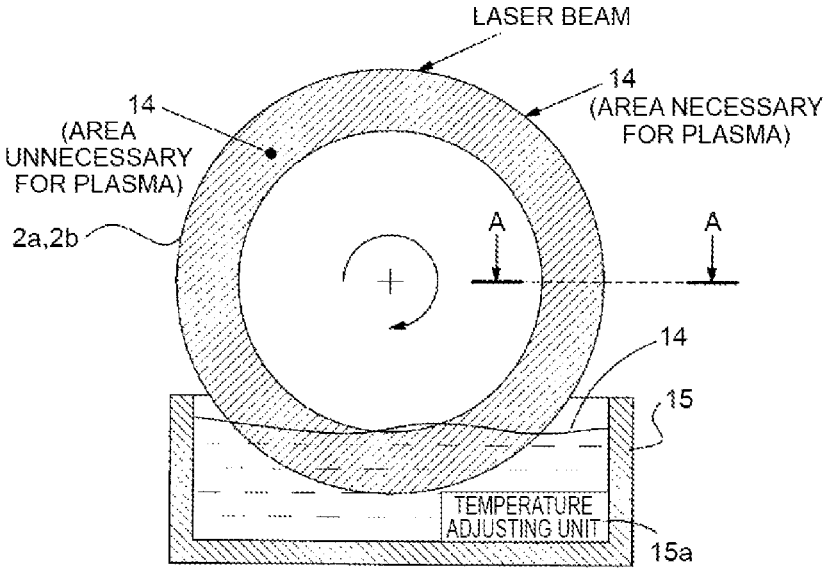
FIG. 11 illustrates a discharge electrode and a container when viewed in a cross-section taken along the line D-D in FIG. 10.
Figure 12A:
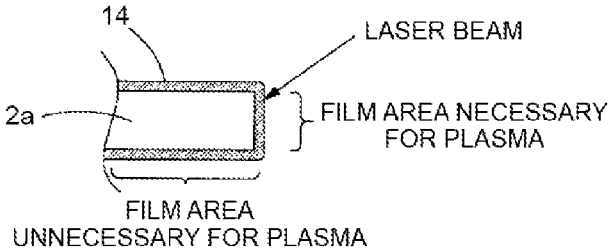
FIG. 12 is a set of cross-sectional views, each taken along the line A-A in FIG. 11. Specifically, FIG. 12(*a*) shows the plasma material when the discharge electrode rotates at a low speed, FIG. 12 (*b*) shows the plasma material when the discharge electrode rotates at a middle speed, and FIG. 12(*c*) shows the plasma material when the discharge electrode rotates at a high speed.
Figure 12B:
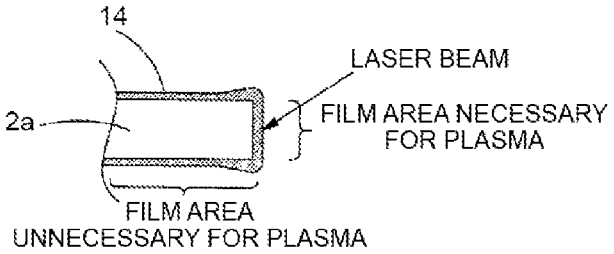
Figure 12C:
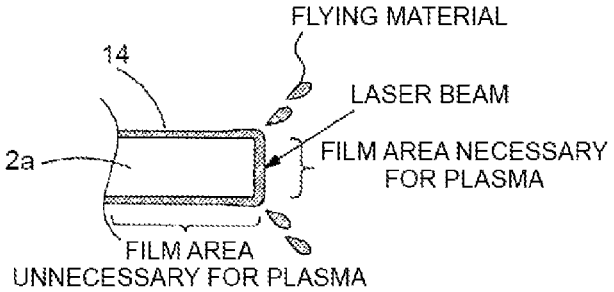

A high temperature plasma material 14 is, for example, liquid tin (Sn) and received (retained) in each of containers 15, as described above. As shown in FIG. 11, the temperature of the melted metal is adjusted (regulated) by a temperature adjusting unit 15*a* disposed in, for example, each of the containers 15.

The temperature of the rotating discharge electrode 2*a*, 2*b* increases as the discharge electrode is irradiated with the laser beam 17 and the discharge takes place. If no cooling is carried out, the surface material of the electrode vaporizes, and the electrode deforms. Each of the containers 15, which retains the high temperature plasma material, has a role to remove the heat from the electrode 2*a*, 2*b* and control the temperature of the electrode 2*a*, 2*b*. To perform this role, each of the containers 15 and 15 has the temperature adjusting unit 15*a*. The heat is removed from each electrode in the associated container 15, and the high temperature plasma material 14 having the elevated temperature is circulated by a circulating mechanism (not shown), which is provided outside, such that the high temperature plasma material is cooled in the passage and reintroduced to the container 15.

The discharge electrodes 2*a* and 2*b* are arranged such that the discharge electrodes 2*a* and 2*b* are partly immersed in the associated containers 15, respectively. The high temperature plasma material 14 is retained in each container 15. As the discharge electrodes 2*a* and 2*b* rotate, the high temperature plasma material 14 is conveyed to the discharge space, and the heat removal from the discharge electrodes 2*a* and 2*b* is performed. The high temperature plasma material 14, which is conveyed to the discharge space, is irradiated with the laser beam 17 from the laser source 17*a*. The high temperature plasma material 14 is vaporized upon being irradiated with the laser beam 17.

When the high temperature plasma material 14 is irradiated with the laser beam 17 and vaporized, a pulse electric power is applied to the discharge electrodes 2*a* and 2*b* from an electric power feed unit 4 such that a pulse discharge is triggered between the discharge electrodes 2*a* and 2*b*. Accordingly, plasma P is produced from the high temperature plasma material 14. A large current is caused to flow upon the discharging. The large current heats and excites the plasma such that the plasma temperature is elevated. As a result, the EUV light is emitted from the high temperature plasma P. The EUV light is condensed to a condensing point f of the light condensing mirror 6 (also referred to as "intermediate condensing point f" in this specification) by the EUV light condensing mirror 6. Then, the EUV light exits from an EUV light outlet 7, and is incident to an exposure equipment 40 attached to the EUV light source device. The exposure equipment 40 is indicated by the broken line.

As shown in FIGS. 1 and 2, each of the disc-shaped discharge electrodes 2*a* and 2*b* of the present invention has a plurality of concentric capturing (trapping) grooves 10*a* and 10*b* in the vicinity of the outer periphery of the discharge electrode to capture the high temperature plasma material. Specifically, as illustrated in FIG. 2, the annular grooves 10*a* and 10*b* are formed in the "area unnecessary for plasma" among those areas where the high temperature plasma material adheres on the discharge electrode 2*a*, 2*b* when the discharge electrode 2*a*, 2*b* moves through the melted high temperature plasma material, which is pooled in the container.

The annular capturing grooves 10*a* and 10*b* are formed on both of the two circular flat surfaces of the disc-shaped discharge electrode 2*a*, 2*b*.

When the disc-shaped discharge electrode 2*a*, 2*b* rotates, the high temperature plasma material 14, which adheres to the "area unnecessary for plasma," moves toward the outer periphery of the disc-shaped discharge electrode 2*a*, 2*b* by the action of the centrifugal force as the revolution-per-minute (rotation speed) of the discharge electrode 2*a*, 2*b* increases.

This is similar to the conventional disc-shaped discharge electrode 2*a*, 2*b*.

As illustrated in FIG. 3(*a*), when the rotation speed of the discharge electrode 2*a*, 2*b* is low, the high temperature plasma material 14 which adheres to the "area unnecessary for plasma" hardly moves. However, as shown in FIG. 3(*b*), the high temperature plasma material 14 moves toward the outer periphery of the disc-shaped discharge electrode 2*a*, 2*b* as the rotation speed of the discharge electrode 2*a*, 2*b* increases to the middle speed. In this situation, that part of the high temperature plasma material 14, which adheres to the "area unnecessary for plasma" and is present inward of the capturing grooves 10*a* and 10*b* (on the side of the center of the disc-shaped discharge electrode 2*a*, 2*b*), flows in the capturing grooves 10*a* and 10*b*, and does not move beyond the capturing grooves 10*a* and 10*b* (on the side of the outer periphery of the disc-shaped discharge electrode 2*a*, 2*b*).

The high temperature plasma material 14 which adheres to the "area unnecessary for plasma" and is present outward of the capturing grooves 10*a* and 10*b* moves toward the outer periphery of the disc-shaped discharge electrode 2*a*, 2*b*. However, because the high temperature plasma material 14 which adheres inward of the capturing grooves 10*a* does not move to the outer periphery of the discharge electrode, the thickness of the film-like high temperature plasma material 14 does not increase very much at the outer periphery of the discharge electrode 2*a*, 2*b*.

As shown in FIG. 3 (*c*), the flow-in speed of the high temperature plasma material 14 that adheres inward of the capturing grooves 10*a* and 10*b* and flows in the capturing grooves 10*a* and 10*b*, among the high temperature plasma material 14 which adheres to the "area unnecessary for plasma" increases as the rotation speed of the discharge electrode 2*a*, 2*b* increases to the high speed. However, the high temperature plasma material 14 does not move beyond (outward of) the capturing grooves 10*a* and 10*b* until the capturing grooves 10*a* and 10*b* are filled with the high temperature plasma material.

Similar to the situation where the discharge electrode 2*a*, 2*b* rotates at the middle speed, the high temperature plasma material 14 which adheres to the "area unnecessary for plasma" and is present outward of the capturing grooves 10*a* and 10*b* moves toward the outer periphery of the disc-shaped discharge electrode 2*a*, 2*b*. However, because the high temperature plasma material 14 which adheres inward of the capturing grooves 10*a* does not move to the outer periphery of the discharge electrode, the thickness of the film-like high temperature plasma material 14 does not increase very much at the outer periphery of the discharge electrode 2*a*, 2*b*.

As described above, each of the disc-like discharge electrodes 2*a* and 2*b* in the extreme ultraviolet light source device according to the present invention is configured to be partly immersed in the melted high temperature plasma material 14, which is pooled in the associated container 15. As the discharge electrode 2*a*, 2*b* rotates, that part of the discharge electrode 2*a*, 2*b* to which the high temperature plasma material 14 adheres moves to the discharge part to convey the high temperature plasma material 14 to the discharge part. The annular capturing grooves 10*a* and 10*b* are provided on the circular surfaces of the disc-shaped discharge electrode 2*a*, 2*b* in the form of concentric circles. The annular capturing grooves 10*a* and 10*b* are formed in a certain part of the annular region where the high temperature plasma material adheres.

Thus, even when the discharge electrode 2*a*, 2*b* rotates at a relatively high speed, the high temperature plasma material 14 which adheres inward of the capturing grooves 10*a* and 10*b* (on the side of the center of the disc-shaped discharge electrode 2*a*, 2*b*) flows in the capturing groves 10*a* and 10*b*, and therefore the high temperature plasma material does not move beyond the capturing grooves 10*a* and 10*b* (toward the outer periphery of the disc-shaped discharge electrode 2*a*, 2*b*).

Accordingly, unlike the conventional rotating discharge electrodes 2*a* and 2*b*, an amount of high temperature plasma material 14 moving toward the outer periphery of the discharge electrode 2*a*, 2*b* reduces, an increase in the film thickness of the high temperature plasma material 14 at the outer periphery of the discharge electrode 2*a*, 2*b* significantly drops, and generation of the liquid droplets of high temperature plasma material 14 leaving the surface of the discharge electrode 2*a*, 2*b* is suppressed.

Therefore, it is possible to reduce the contamination of the inner wall of the chamber and the respective components disposed in the chamber with the high temperature plasma material 14 flying from the discharge electrodes 2*a* and 2*b*.

Figure 10:
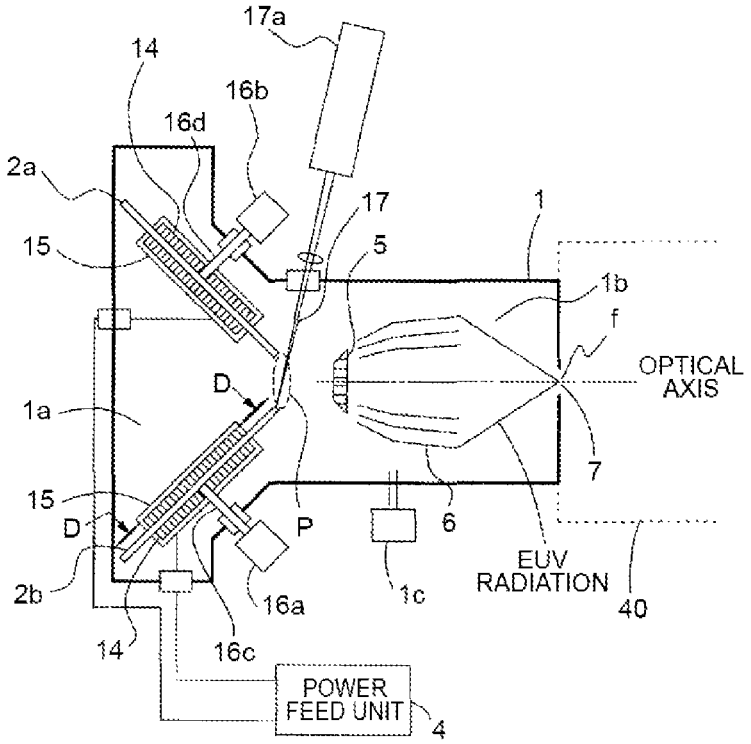
FIG. 10 is a view useful to describe a DPP type EUV light source device.

The film thickness adjusting mechanism 12, which is not shown in FIG. 10, is shown in FIG. 4. In FIG. 4, the film thickness adjusting mechanism 12 is configured to adjust the thickness of the high temperature plasma material on the discharge electrode 2*a*, 2*b* to an optimal value in the film area necessary for plasma. In other words, the space above the curved surface of the disc-shaped discharge electrode 2*a*, 2*b*, which is irradiated with the laser beam, is restricted such that the film thickness of the high temperature plasma material which adheres to the curved surface is adjusted to an optimal value.

Referring back to FIG. 3, the angle of the side wall of each capturing groove 10*a* in this drawing has a negative value relative to the reference plane, i.e., the circular flat surface of the discharge electrode 2*a*, 2*b*. It should be noted that the angle of the side wall of the capturing groove 10*a* is not limited to such negative angle. For example, the angle of the side wall of the capturing groove 10*a* may be vertical to the circular flat surface of the discharge electrode 2*a*, 2*b*. When the side wall of the capturing groove has the negative angle relative to the circular flat surface, there is an advantage, i.e., the high temperature plasma material, which adheres inward of the capturing grooves 10*a* and 10*b*, is easy to flow into the capturing grooves 10*a* and 10*b* and difficult to flow out of the capturing grooves 10*a* and 10*b* once trapped therein. Accordingly, it is preferred that the angle of the side wall of the capturing groove 10*a* be a negative angle relative to the circular flat surface of the discharge electrode 2*a*, 2*b*, if the circular flat surface of the discharge electrode 2*a*, 2*b* is the reference plane.

As illustrated in FIG. 1, FIG. 2, and other drawings, the two annular capturing grooves 10*a* and 10*b* are concentrically formed on each of the circular surfaces in the embodiment of the invention. When a plurality of capturing grooves are provided on each circular flat surface of each discharge electrode 2*a*, 2*b* in the form of concentric circles in this manner, it is possible to increase a possible amount of capturing the high temperature plasma material, which adheres to each circular flat surface of each disc-shaped discharge electrode 2*a*, 2*b*, as compared to a configuration that has a single annular capturing groove on each circular flat surface of each discharge electrode. Because of the above-described configuration, it is possible to further reduce the contamination of the chamber inner wall and the respective components disposed in the chamber with the high temperature plasma material flying (scattering) from the discharge electrodes 2*a* and 2*b* while the discharge electrodes 2*a* and 2*b* are rotating at a high speed.

It is also possible to reduce a volume of each of the capturing grooves when a plurality of capturing grooves are formed. This makes it possible to reduce the depth of each capturing groove. Accordingly, it is possible to sufficiently and reliably capture (stop and hold) the high temperature plasma material present in the "area unnecessary for plasma generation" while the decrease in the strength of each discharge electrode, which is caused by the provision of the capturing grooves, is suppressed.

Figure 6A:
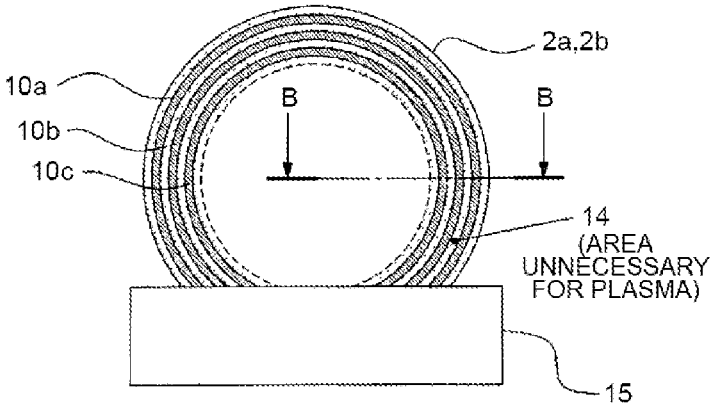
FIG. 6(*a*) shows a configuration when annular capturing grooves are formed in each single circular surface in the form of three concentric circles, and FIG. 6(*b*) is an enlarged cross-sectional view taken along the line B-B in FIG. 6(*a*).
Figure 6B:
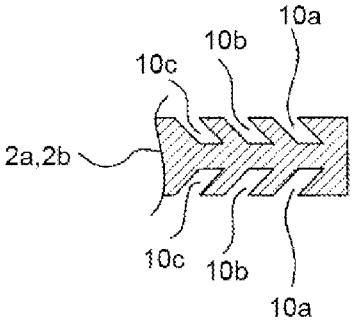

FIG. 1, FIG. 2, and other drawings show the configuration that has two annular capturing grooves 10*a* and 10*b*, in the form of concentric circles, on each of the circular surfaces. As shown in FIG. 6, however, there may be provided three annular capturing grooves 10*a*, 10*b* and 10*c*, in the form of concentric circles, on each of the circular surfaces. FIG. 6 includes FIGS. 6(*a*) and 6(*b*). FIG. 6(*a*) is a drawing when viewed from the direction of the arrow A of FIG. 1. FIG. 6(*b*) is a cross-sectional view taken along the line B-B in FIG. 6(*a*).

Figure 7A:
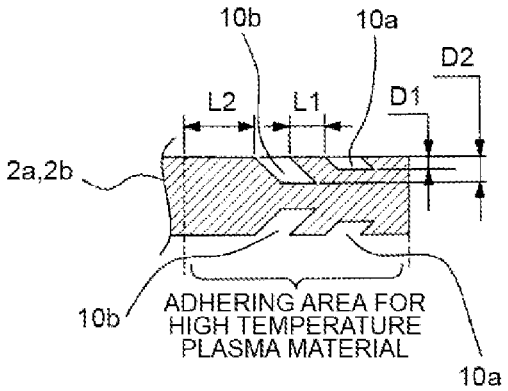
FIG. 7(*a*) shows a configuration when the two capturing grooves have different depths from each other, and FIG. 7(*b*) shows a configuration when the three capturing grooves have different depths form each other.
Figure 7B:
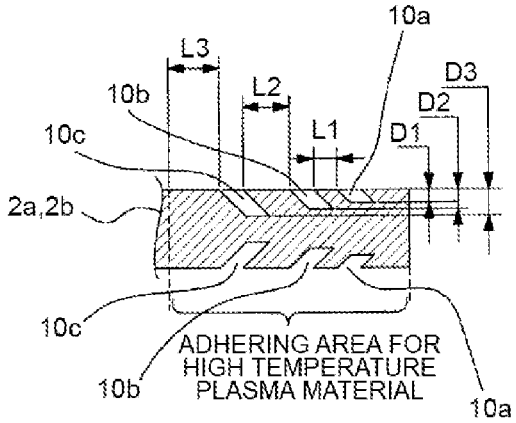

It should also be noted that all the capturing grooves may not have the same depth. For example, as shown in FIGS. 7(*a*) and 7(*b*), the capturing grooves may have the decreasing depth as the capturing grooves approach the outer periphery of the discharge electrode 2*a*, 2*b*. In the configuration shown in FIG. 7(*a*), there are provided two capturing grooves 10*a* and 10*b* in each of the flat surfaces, and the depth D1 of the groove 10*a* formed at a position closer to the outer periphery of the discharge electrode 2*a*, 2*b* is shallower that the depth D2 of the groove 10*b* formed next to the groove 10*a*.

It is assumed that an amount of high temperature plasma material to be captured by each capturing groove is substantially proportional to a size of a flat region next to the capturing groove 10*a* on the center side of the circular flat surface, among the area where the high temperature plasma material adheres on the circular flat surface of the disc-shaped discharge electrode 2*a*, 2*b*. Practically or roughly, it is assumed that an amount of high temperature plasma material to be captured by each capturing groove is substantially proportional to the length of the flat region next to the capturing groove 10*a* in the radial direction.

Therefore, if the length of the flat region next to the groove 10*a* on the center side of the circular flat surface in the radial direction is represented by L1, and the length of the flat region next to the groove 10*b* on the center side of the circular flat surface in the radial direction is represented by L2, then the depths D1 and D2 of the grooves 10*a* and 10*b* may be designed to satisfy that D1:D2=L1:L2 or D1:D2≈L1:L2.

The configuration of FIG. 7(*b*) has three capturing grooves in each flat surface. In this configuration, there are provided three capturing grooves 10*a*, 10*b* and 10*c* in each flat surface. The depth D1 of the groove 10*a* at a position closest to the outer periphery of the discharge electrode 2*a*, 2*b* is shallower than the depth D2 of the adjacent groove 10*b*. The depth D2 is shallower than the depth D3 of the groove 10*c* next to the groove 10*b*. When the length of the flat region next to the groove 10*a* on the center side of the circular flat surface in the radial direction is represented by L1, the length of the flat region next to the groove 10*b* on the center side of the circular flat surface in the radial direction is represented by L2, and the length of the flat region next to the groove 10*c* on the center side of the circular flat surface in the radial direction is represented by L3, then the depths D1, D2 and D3 of the grooves may be designed to satisfy that D1:D2:D3=L1:L2:L3 or D1:D2:D3≈L1:L2:L3.

In the configuration shown in FIG. 7, at least one of the capturing grooves 10*a* has a different depth from the remaining groove(s). However, the present invention is not limited to such configuration. For example, the capturing grooves may have the same depth, and at least one of the capturing grooves has a different width from the remaining groove(s).

Figure 8:
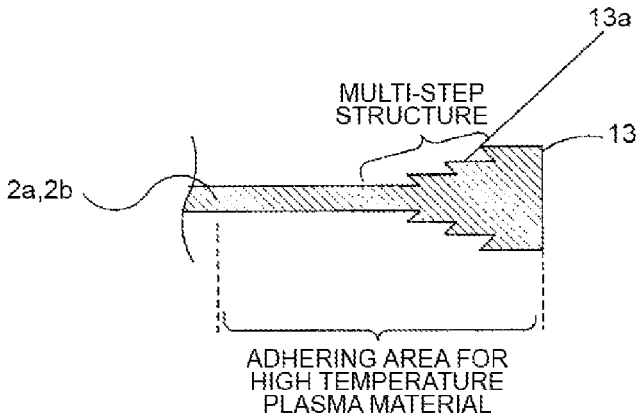
FIG. 8 shows a configuration when the discharge electrode has a protruding part at its outer periphery to provide a multi-step concave portion for capturing.

It should be noted that a protruding part 13 may be provided at the outer periphery of the discharge electrode 2*a*, 2*b* as shown in FIG. 8, instead of providing a plurality of capturing grooves. It is assumed that the same advantage may be obtained by forming the capturing concave portions 13*a* in the protruding part 13 in the form of multiple steps. However, the multi-step structure is not preferred because of the following reason. The discharge electrode 2*a*, 2*b* has a thickness of about 5 mm and rotates at a high speed. If the multi-step structure is employed as shown in FIG. 8, and the center area of the discharge electrode has a reduced thickness, then the discharge electrode may deform and/or break due to a load acting in the vicinity of the rotation shaft of the discharge electrode 2*a*, 2*b* in early timing after the discharge electrode 2*a*, 2*b* starts rotating. This is not desirable.

As the operation time of the EUV light source device goes on, an amount of high temperature plasma material that flows in the capturing grooves 10*a*, 10*b*, . . . formed on the disc-shaped discharge electrodes 2*a* and 2*b* increases. When the flow-in amount of high temperature plasma material exceeds the capturing capacity of the capturing grooves 10*a*, 10*b*, . . . , an amount of high temperature plasma material that moves toward the outer periphery of the disc-shaped discharge electrode 2*a*, 2*b* increases. As a result, the thickness of the film-like high temperature plasma material increases at the outer periphery of the discharge electrode 2*a*, 2*b*, and the liquid droplets of high temperature plasma material which leave the surface of the electrode 2*a*, 2*b* are created more frequently. To deal with it, it is preferred to periodically remove the high temperature plasma material from the capturing grooves 10*a*.

Figure 9A:
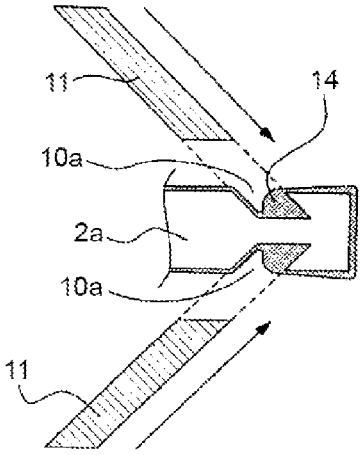
FIG. 9 is a set of views useful to describe material removing mechanisms to remove the high temperature plasma material that have flowed in the capturing grooves.
Figure 9B:
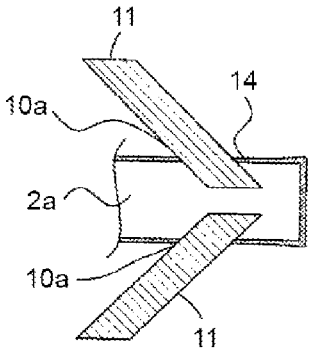
Figure 9C:
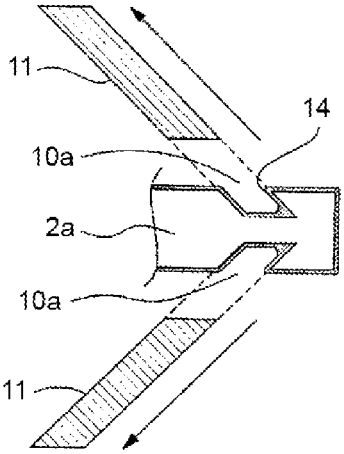

For this reason, as shown in FIGS. 1, 5 and 9, for example, material removing mechanisms 11 may be provided to remove the high temperature plasma material from the capturing grooves 10*a* and 10*b*.

As shown in these drawings, there are provided four material removing mechanisms 11 for four capturing grooves in each of the two disc-shaped discharge electrodes 2*a* and 2*b*, respectively. For example, when the two capturing grooves are concentrically formed in each circular flat surface of each discharge electrode, there are provided eight material removing mechanisms 11 in total for the two discharge electrodes 2*a* and 2*b*.

As illustrated in FIG. 9, each of the material removing mechanisms 11 has a rod-like shape, and the front end (tip) thereof has a shape that can move into and out of the associated capturing groove 10*a*.

As shown in FIG. 9(*a*), when an amount of high temperature plasma material flowing into each of the capturing grooves 10*a* increases, then the associated material removing mechanism 11 moves in an insertion direction toward the capturing groove 10*a* concerned. Eventually, as shown in FIG. 9(*b*), the front end of each of the material removing mechanisms 11 is inserted in the associated capturing groove 10*a*. In this situation, the discharge electrodes 2*a* and 2*b* are rotating. Therefore, the high temperature plasma material that flows in the capturing grooves 10*a* is scraped out slowly, with the high temperature plasma material being in contact with the material removing mechanisms 11.

After most of the high temperature plasma material is scraped out from each of the capturing grooves 10*a*, the material removing mechanism 11 is moved in a direction to retract from the associated capturing groove 10*a*.

The high temperature plasma material which is scraped out from the material removing mechanism 11 falls in the direction of gravity. Preferably, there is provided a material receiving unit to receive the falling high temperature plasma material. For example, as shown in FIG. 5, the containers which retain the melted high temperature plasma material may have a larger size as compared to the containers shown in FIG. 10. Such large containers may receive the falling high temperature plasma material.

REFERENCE NUMERALS AND SIGNS

1: Chamber
1*a*: Discharge part
1*b*: EUV light condensing portion
1*c*: Gas discharging unit
2*a*, 2*b*: Discharge electrode
4: Power supply unit
5: Foil trap
6: EUV light condensing mirror
10*a*, 10*b*, 10*c*: Capturing groove
11: Material removing mechanism
12: Film thickness adjusting mechanism
14: High temperature plasma material
15: Container
15*a*: Temperature adjusting unit
16*a*, 16*b*: Rotating motor
16*c*, 16*d*: Rotating shaft
17: Laser beam
17*a*: Laser source
40: Exposure equipment
P: High temperature plasma

The invention claimed is:

1. A pair of discharge electrodes for use in a light source device including a pulse electric power feeding unit configured to feed a pulse electric power to the pair of discharge electrodes, material feeding units configured to feed a material for light emission, onto the pair of discharge electrodes respectively, and an energy beam irradiation unit configured to irradiate the material on a curved surface of each said discharge electrode with an energy beam to vaporize the material, each of the material feeding units having a container to retain a melt of the material, each said discharge electrode comprising at least one groove formed in each of two surfaces of each said discharge electrode, said pair of discharge electrodes being spaced from each other, each said discharge electrode being configured to rotate, and part of each said discharge electrode passing through the melt of the material retained in the associated container upon rotation such that the material adheres to a first area of each said discharge electrode.

2. The pair of discharge electrodes according to claim 1, wherein a material removing mechanism having a rod-like shape is provided for each of the capturing grooves, and a front end of the material removing mechanism can move into and out of the associated capturing groove.

3. The pair of discharge electrodes according to claim 1, wherein said at least one groove includes a plurality of grooves, and at least one of the plurality of grooves has a different depth from the remaining grooves.

4. The pair of discharge electrodes according to claim 3, wherein a ratio of depths of the plurality of grooves to each other is equal to or substantially equal to a ratio of lengths of respective flat regions next to the grooves on a center side of each said flat surface to each other, the high temperature plasma material adhering on said flat regions of each said flat surface of each said discharge electrode.

5. The discharge electrodes according to claim 1, wherein an angle of a sidewall of each said groove has a negative value relative to one of the two flat surfaces of each said discharge electrode.

6. The pair of discharge electrodes according to claim 1, wherein said at least one groove includes a plurality of grooves, and at least one of the plurality of grooves has a different width from the remaining grooves.

7. The pair of discharge electrodes according to claim 1, wherein said at least one groove includes an annular groove.

8. The pair of discharge electrodes according to claim 1, wherein said at least one groove includes a plurality of grooves in the form of concentric circles.

9. The pair of discharge electrodes according to claim 1, wherein each said discharge electrode has a disc shape, and said curved surface of each said discharge electrode extends along an outer periphery of the disc shape.

10. A pair of discharge electrodes for use in a light source device including a pulse electric power feeding unit configured to feed a pulse electric power to the pair of discharge electrodes, material feeding units configured to feed a material for light emission, onto the pair of discharge electrodes respectively, and an energy beam irradiation unit configured to irradiate the material at an outer periphery of each said discharge electrode with an energy beam to vaporize the material, each of the material feeding units having a container to retain a melt of the material, each said discharge electrode comprising at least one element to capture the material on at least one of two surfaces of each said discharge electrode.

11. The pair of discharge electrodes according to claim 10, wherein said at least one element includes at least one groove formed in each of the two surfaces of each said discharge electrode.

12. The pair of discharge electrodes according to claim 10, wherein said at least one element includes at least one protruding part at one end of each said discharge electrode, and said at least one protruding part includes at least one concave portion.

13. A light source device comprising:

a pair of discharge electrodes spaced from each other;

a pulse electric power feeding unit configured to feed a pulse electric power to the discharge electrodes;

material feeding units configured to feed a material for light emission, onto the discharge electrodes, each of the material feeding units having a container to retain a melt of the material;

an energy beam irradiation unit configured to irradiate the material on each said discharge electrode with an energy beam to vaporize the material; and an element configured to capture the material on each said discharge electrode;

wherein said element includes at least one groove formed in each of two surfaces of each said discharge electrode.

14. The light source device according to claim 13, wherein said element includes at least one protruding part at one end of each said discharge electrode, and said at least one protruding part includes at least one concave portion.

15. The light source device according to claim 13 further including a material removing mechanism configured to remove the material from the element.

16. The light source device according to claim 13, wherein said at least one groove includes a plurality of grooves, and at least one of the plurality of grooves has a different depth from the remaining grooves.

17. The light source device according to claim 13, wherein said at least one groove includes a plurality of grooves, and at least one of the plurality of grooves has a different width from the remaining grooves.

18. The light source device according to claim 13, wherein said light source device is a laser produced plasma type extreme ultraviolet light source device, or a discharge produced plasma type extreme ultraviolet light source device.

* * * * *